United States Patent [19]

Stahlecker

[11] Patent Number: 5,016,432

[45] Date of Patent: May 21, 1991

[54] YARN PIECING ARRANGEMENT FOR TWO COMPONENT PRESTRENGTHENED YARN SPINNING MACHINE

[75] Inventor: Fritz Stahlecker, Bad Überkingen, Fed. Rep. of Germany

[73] Assignee: Hans Stahlecker, Fed. Rep. of Germany; a part interest

[21] Appl. No.: 350,350

[22] Filed: May 11, 1989

[30] Foreign Application Priority Data

May 20, 1988 [DE] Fed. Rep. of Germany ..... 3817221

[51] Int. Cl.[5] ..... D01H 1/115; D01H 15/00

[52] U.S. Cl. ..... 57/261; 57/328; 57/352

[58] Field of Search ..... 57/22, 261, 263, 279, 57/280, 328, 333, 352

[56] References Cited

U.S. PATENT DOCUMENTS

| | | | |
|---|---|---|---|
| 3,616,632 | 11/1971 | Reuter et al. | 57/279 |
| 4,484,436 | 11/1984 | Nakayama et al. | 57/328 |
| 4,517,794 | 5/1985 | Sakai et al. | 57/304 |
| 4,768,337 | 9/1988 | Stahlecker et al. | 57/328 |
| 4,790,130 | 12/1988 | Stahlecker et al. | 57/261 |
| 4,819,419 | 4/1989 | Stahlecker et al. | 57/261 |
| 4,819,422 | 4/1989 | Stahlecker et al. | 57/328 |
| 4,831,816 | 5/1989 | Stahlecker | 57/328 |
| 4,833,874 | 5/1989 | Stahlecker et al. | 57/261 |
| 4,845,936 | 7/1989 | Artzt et al. | 57/261 |

FOREIGN PATENT DOCUMENTS 3634464 7/1988 Fed. Rep. of Germany .

*Primary Examiner*—Joseph J. Hail, III

*Attorney, Agent, or Firm*—Evenson, Wands, Edwards, Lenahan & McKeown

[57] ABSTRACT

In a spinning machine having a plurality of spinning units, which each produce a package having a double yarn, which is used as a feeding package for twisting, and having devices for carrying out the piecing, it is provided that a suction gripper is constructed such that it can simultaneously take in two yarns from false twisting elements, which are arranged at a distance from one another.

22 Claims, 7 Drawing Sheets

20
10
19'
11
56',57'
12
23
22'
60
24'
25'
38
37'
72
34'
69
64
35
D
39,40
70,71
73
63
67
65
66
68
7
62
61
48
47'
49'
50'
51

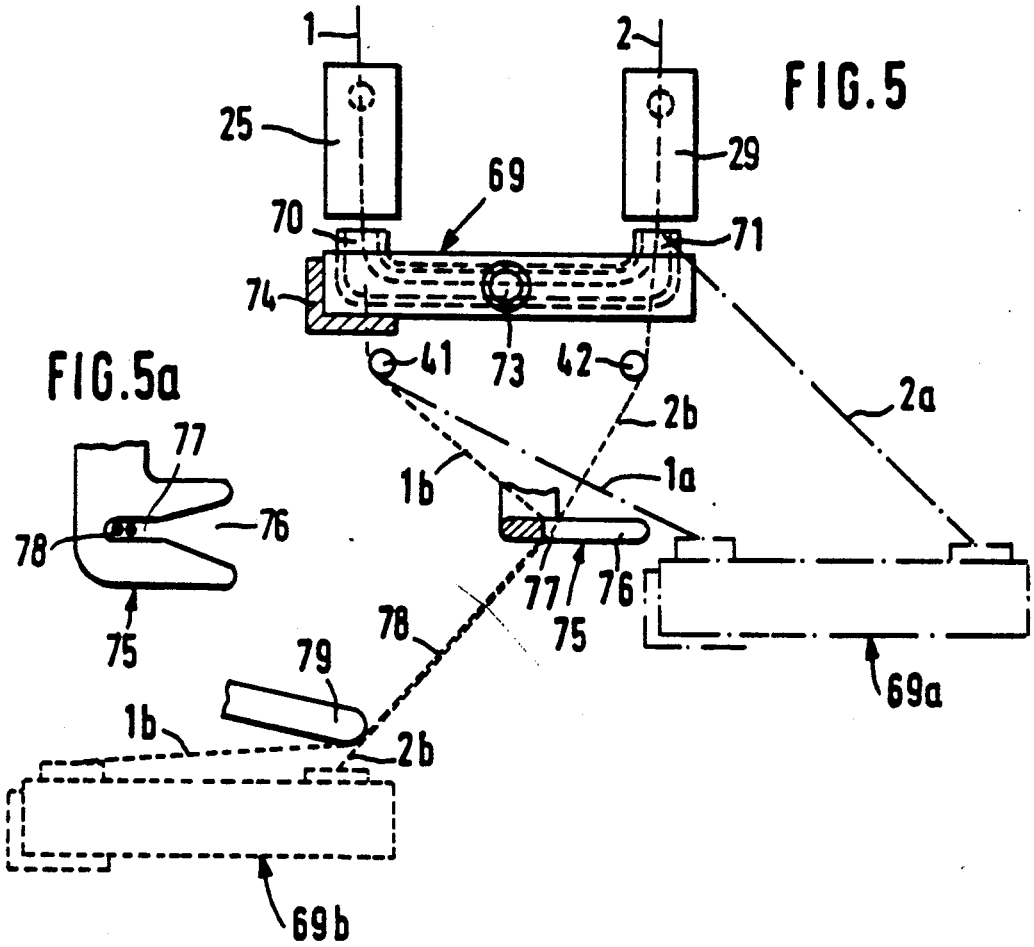
FIG.5
FIG.5a
FIG.6
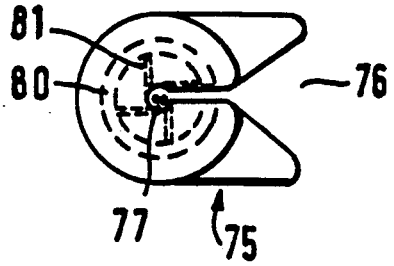

YARN PIECING ARRANGEMENT FOR TWO COMPONENT PRESTRENGTHENED YARN SPINNING MACHINE

BACKGROUND AND SUMMARY OF THE INVENTION

This invention relates to a spinning machine having a plurality of spinning units, which each have two drafting units, followed by pneumatic false twisting elements, a withdrawal device and a wind-up device for winding two prestrengthened yarns onto a package serving as a feeding package for twisting. Piecing devices are provided for carrying out a piecing at a spinning unit, which piecing devices contain a suction gripper, which can be applied to the false twisting elements to take in the yarns at the false twisting elements and feed them to a connecting device.

In a known arrangement of the initially mentioned type German Published Examined Patent Application (DE-A) 36 34 464, the two pneumatic false twisting elements of a spinning unit are arranged in a V-shape, so that the outlet openings of these false twisting elements, from which the yarns emerge, are located directly next to one another. It is therefore possible to simultaneously grip both yarns by means of a suction gripper.

In the case of an air spinning machine, which produces a single yarn, (U.S. Pat. No. 4,517,794), it is known to convey the yarn for a piecing from a false twisting nozzle by means of a suction gripper to a splicer. In this case, stationary suction openings are assigned to the false twisting nozzles, these suction openings first receiving the yarn to be spliced. The suction gripper, in each case, withdraws the yarns to be spliced from this suction opening.

An object of the invention is to develop a spinning machine of the initially mentioned type such that the two false twisting elements do not have to be aligned in a V-shape with respect to one another.

This object is achieved in that the suction gripper is equipped with devices for the simultaneous taking in of the yarns emerging from the false twisting elements arranged at a distance from one another.

As a result, it is possible to directly take in the yarns, even if the two false twisting elements, when the yarn movement is at first in parallel, are arranged at a larger distance from one another.

In a further development of preferred embodiments of the invention, it is provided that the suction gripper is combined with devices for starting the operation of the false twisting elements. As a result, it is ensured that yarns do not emerge from the false twisting elements before the suction gripper has been brought into the take-over position. Additional suction devices or the like will then not be necessary.

In a further development of preferred embodiments of the invention, it is provided that the devices for the piecing contain devices for guiding the two yarns together. This facilitates the handling of the two yarns in the form of the double yarn.

In a further development of preferred embodiments of the invention, it is provided that the devices for the piecing contain a delivery device, which can be arranged in the path of the yarn between the suction gripper and the false twisting elements. This delivery device determines at which speed the yarns are withdrawn from the false twisting elements. This speed can thus be selected such that, already during the piecing, individual yarns and thus also a double yarn are produced, which are identical with the double yarn spun operationally.

Other objects, advantages and novel features of the present invention will become apparent from the following detailed description of the invention when considered in conjunction with the accompanying drawings.

BRIEF DESCRIPTION OF THE DRAWINGS

FIGS. 5 and 5*a* are schematic enlarged views showing details of the devices of FIGS. 1–4 for the piecing after a yarn breakage;

FIG. 6 is a view taken in the travel direction of the yarn of a yarn guide combined with an injector;

DETAILED DESCRIPTION OF THE DRAWINGS

Figure 1:
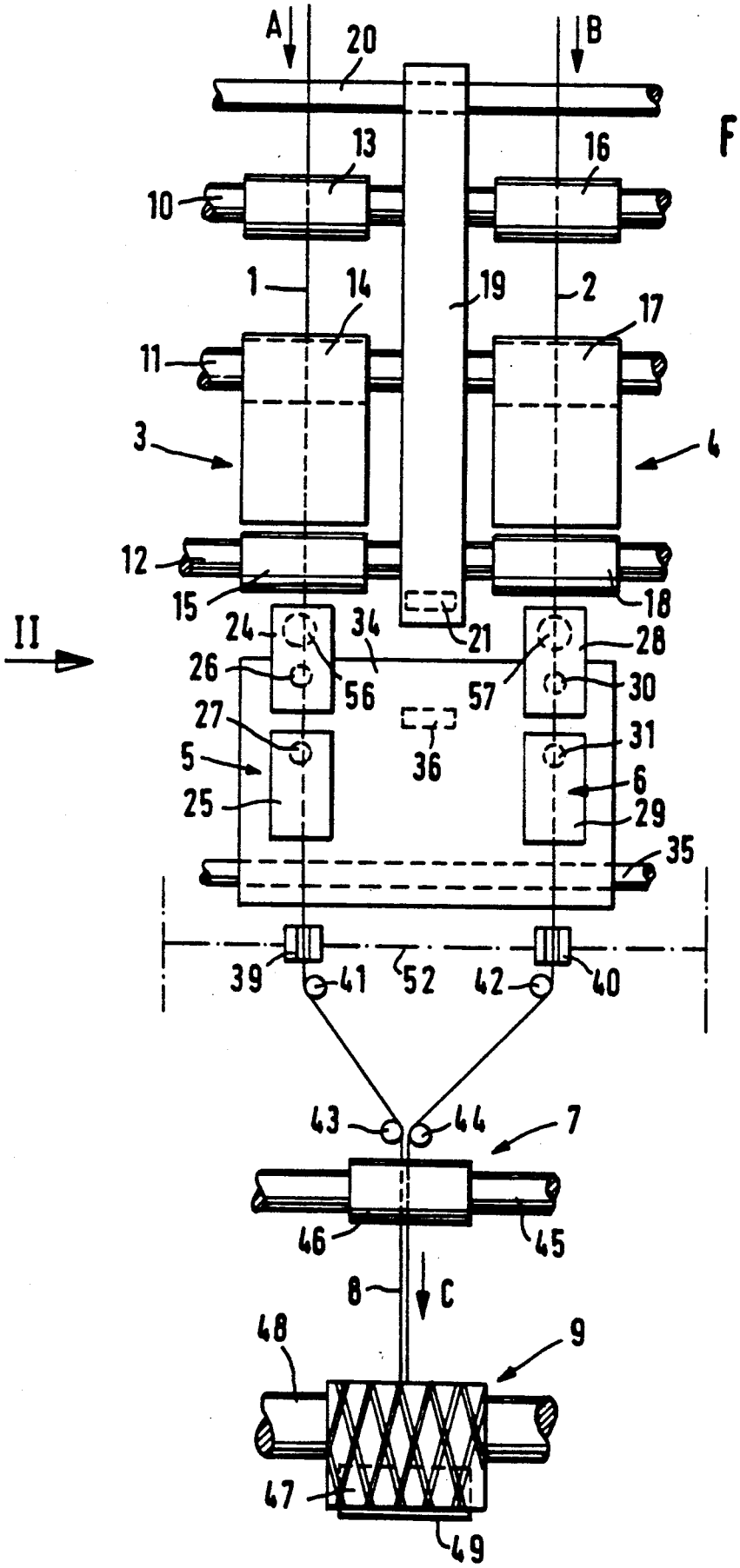
FIG. 1 is a schematic representation of a spinning unit, viewed from the direction of the operator's side constructed according to a preferred embodiment of the invention.
Figure 2:
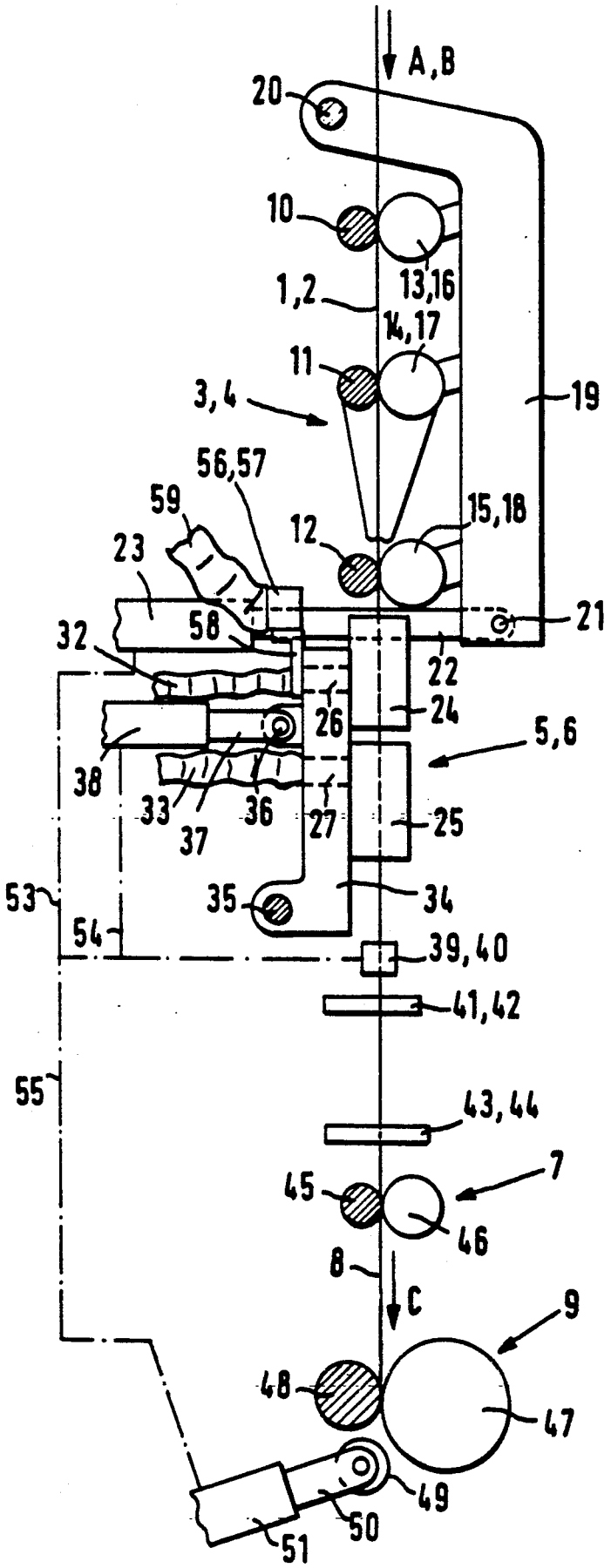
FIG. 2 is a view of the spinning unit of FIG. 1 in the direction of the arrow II.

In FIG. 1 and 2, a spinning unit of a spinning machine is shown in its operating condition. A spinning machine has a plurality of such spinning units, which are arranged in a row next to one another on one side of the machine, and the individual elements of which are driven by drives arranged in end sections.

Two slivers enter into the spinning unit in parallel to one another in the direction of the arrows (A and B) and are drawn to yarns 1, 2 of a predetermined size in drafting units 3, 4. The drafting units 3, 4 are followed by pneumatic false twisting devices 5, 6, in which the yarns 1, 2 are prestrengthened, their strength, however, remaining so weak that they would not be usable as a single yarn. These two prestrengthened yarns 1, 2, are guided together after leaving the false twisting devices 5, 6, and are withdrawn by means of a withdrawal device 7. From the withdrawal device 7, the two yarns 1, 2 move as a double yarn 8 in the direction of the arrow (C) to wind-up device 9, by which they are wound up side-by-side to a cross-wound package 47.

The drafting units 3, 4 contain common bottom cylinders 10, 11, 12, which extend through in the longitudinal direction of the machine and are driven at the machine end. Top rollers 13, 14, 15; 16, 17, 18 are assigned in each case to the bottom cylinders 10, 11, 12, and are held by a common weighting arm 19. The two drafting units 3, 4 are shown as three-cylinder apron drafting units. Other drafting units are also contemplated. The weighting carrier 19 is pivotable around a shaft 20 extending in the longitudinal direction of the machine. At its other end 21, a piston 22 of a pneumatic press 23 is pivotally connected, via which the weighting arm 19 can be swivelled around the shaft 20 for the opening and closing of the drafting units 3, 4.

The false twisting devices 5, 6 each contain two air nozzles 24, 25; 28, 29, which are arranged behind one another and of which, in each case, the first one 24, 28 is constructed as an intake nozzle, which causes no or almost no false twist in the yarns 1, 2. The respectively second air nozzle 25, 29 is constructed as a false twisting nozzle, which provides the yarns 1, 2 with a false twist. The air nozzles 24, 25; 28, 29 each have connections 26, 27, 30, 31 for compressed-air feeding lines which are constructed as flexible hoses 32, 33, as outlined in FIG. 2.

The air nozzles 24, 25; 28, 29 are mounted at a common nozzle plate 34, which is pivotable around a shaft 35 extending in the longitudinal direction of the machine. The nozzle plate 34 is provided with a connecting element 36, to which the piston 37 of a pneumatic press 38 is connected. As shown particularly in FIG. 2, the nozzle plate 34 is arranged behind the air nozzles 24, 25, 28, 29, so that they are accessible from the operator's side.

Behind the false twisting devices 5, 6, a yarn guard 39, 40 is provided for each yarn 1, 2. The yarn guards 39, 40 operate preferably in a no contact manner and determine the presence or absence of the yarns 1, 2. Directly behind the yarn guards 39, 40, yarn guides 41, 42 are provided, over which the prestrengthened yarns 1, 2 are deflected toward the center of the arrangement, where, by means of two additional yarn guides 43, 44, they are guided toward one another up to a short distance from one another. The two yarns 1, 2 enter as a double yarn 8 into the withdrawal device 7, which is formed by a driven roller 45, which extends through in the longitudinal direction of the machine, and by a respective pressure roller 46.

The wind-up device 9 is shown only very schematically. It contains a driven winding roller 48, which extends through in the longitudinal direction of the machine and on which the cross-wound package 47 is placed. The wind-up device 9 includes devices for cross-winding the yarns, which are not shown in detail, and devices for compensating changes of length and tensions, which occur during this cross-winding. The cross-wound package 47, is disposed in such a manner by means of a holding device, which is not shown, that it can be moved away from the winding roller 48. For this purpose, each spinning unit is equipped with a lift-off roller 49, which is arranged on the piston 50 of a pneumatic press 51.

Figure 3:
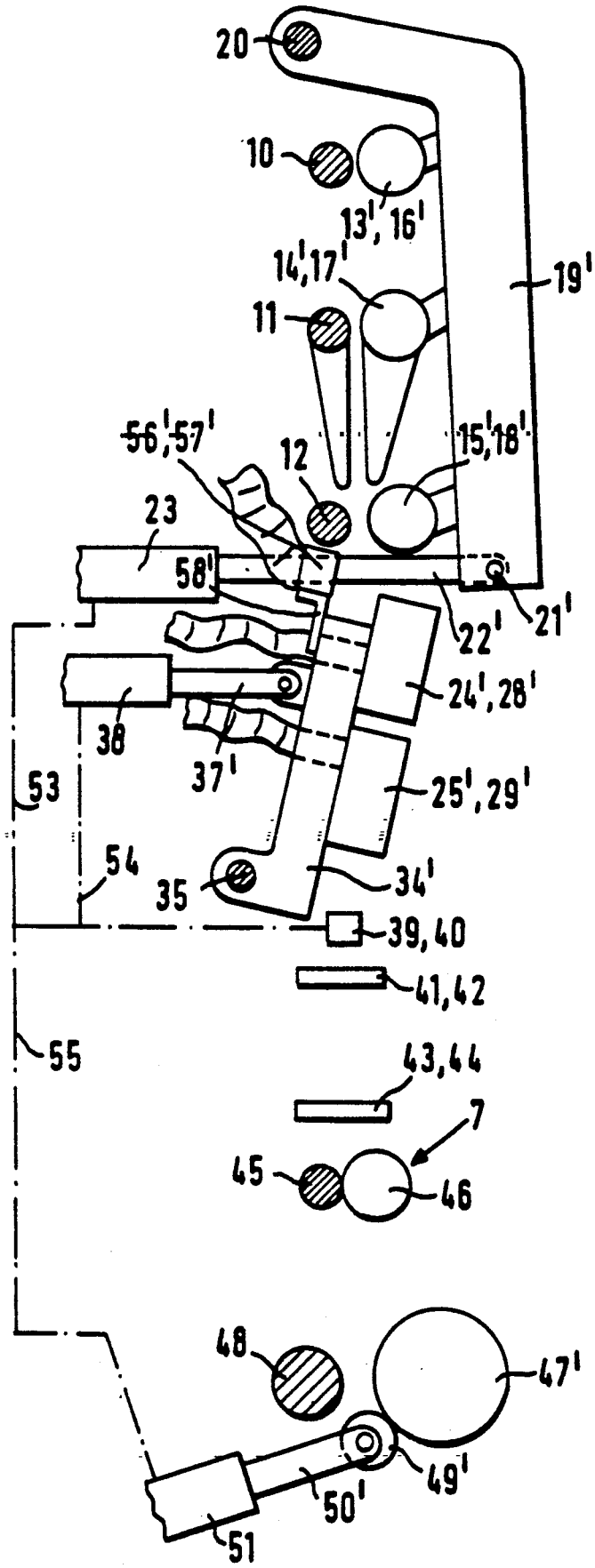
FIG. 3 is a view of the spinning unit according to FIG. 2 after a yarn breakage.

In FIG. 1 and 2, it is shown by dash-dotted lines with which elements the two yarn guards 39, 40 are connected, and that they are also connected with one another such that even the breakage of one yarn 1 or 2 triggers a stoppage of the concerned spinning unit. If a yarn breakage is determined, the pneumatic presses 23, 38 and 51 are actuated so that the drafting units 3, 4 are opened up, the pneumatic false twisting devices 5, 6 are brought into their inoperative position, and the cross-wound spool 47 is lifted off the winding roller 48. This position after a yarn breakage is shown in FIG. 3. The dash-dotted connecting lines 52, 53, 54, 55 indicate that the yarn guards 39, 40 are connected with the corresponding elements.

At the nozzle plate 34, two suction nozzles 56, 57 are mounted by means of a holding device 58, are located in the area of the rear side of the nozzle plate 34, and are connected to a vacuum source via flexible lines 59. When the nozzle plate 34 is swivelled away in the case of a yarn breakage, into the inoperative position, the suction nozzles 56, 57 each arrive at the outlet of the drafting units 3, 4.

The positions of the individual elements, at the time of the occurrence of a yarn breakage, are shown in FIG. 3, in which case the reference numbers of those elements which have changed their position are provided with a prime "1". It is 10 shown that the weighting arm 19' with the top rollers 13', 14', 15'; 16', 17', 18' was lifted off the bottom rollers 10, 11, 12. Thus the continued supply of sliver was interrupted. The air nozzles 24', 25' and 28', 29' were brought into the inoperative Position. The suction nozzles 56', 57' were brought to the area of the outlet of the drafting units 3, 4. In addition, the drive of cross-wound package 47' by the winding roller 48 was interrupted. The stoppage of a spinning unit and the connected interruption of the spinning operation, when only one yarn component breaks, expediently takes place in that the other yarn component is not completely wound onto the drive of cross-wound package 47'.

Figure 4:
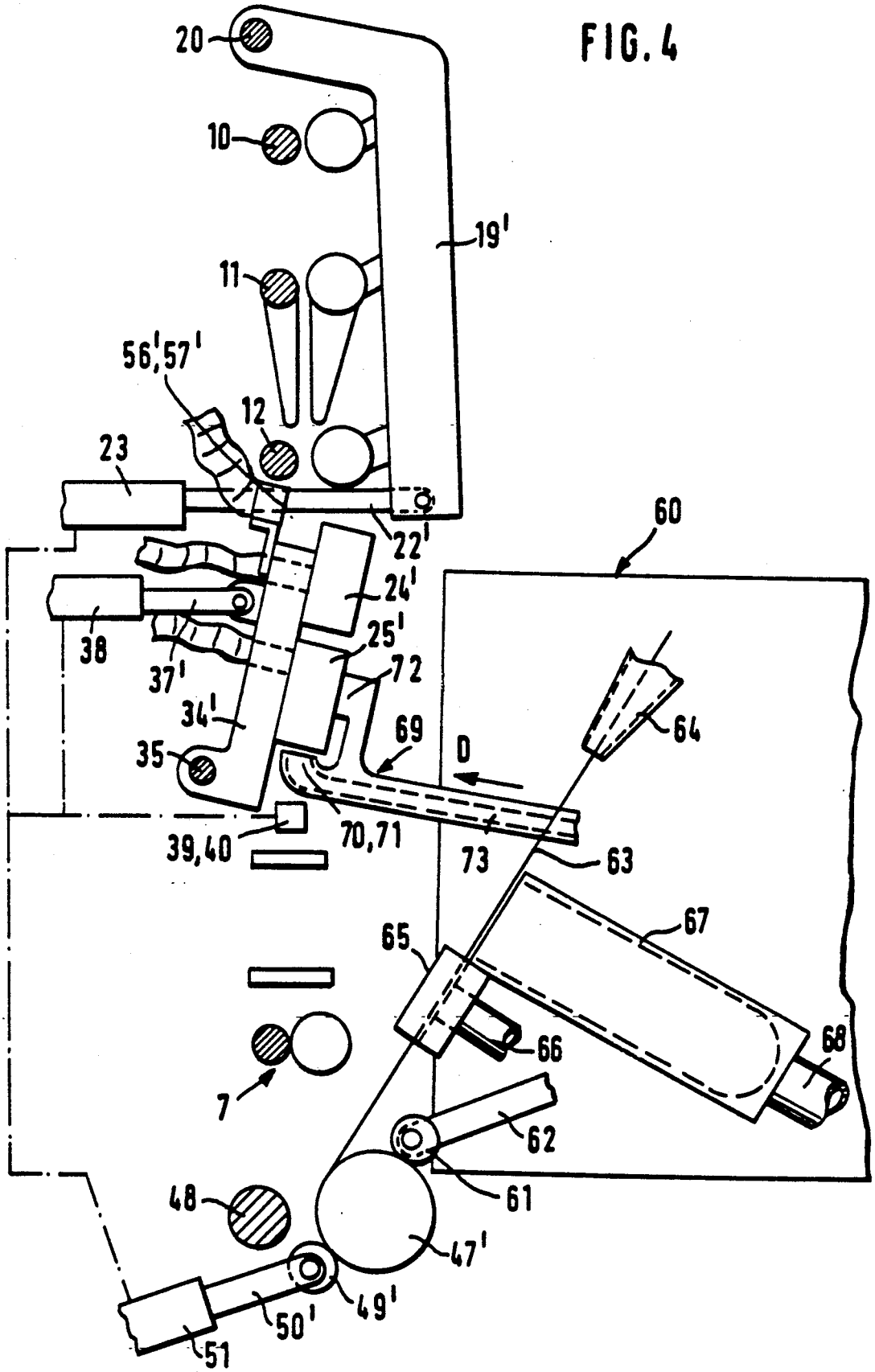
FIG. 4 is a view of the spinning unit according to FIG. 3 during a piecing operation.

The piecing operation, i.e., the resuming of the operation of a stopped spinning unit, is carried out by means of a movable servicing device 60, which is shown schematically in FIG. 4. This movable servicing device 60, in a manner not shown in detail, can be moved on tracks along the spinning machine and can be applied to a spinning unit having a yarn breakage. The respective spinning unit emits a signal, by means of which the servicing device 60 is called. The servicing device 60 is equipped with devices, by means of which a double yarn 63 is withdrawn and wound off the lifted-off cross-wound package 47' and is taken to a connecting device, particularly a splicing device 65. In the embodiment shown, an auxiliary winding roller 61 is applied to the cross-wound package 47', is arranged on an arm 62, which can be moved out, and has a rotating drive, by means of which it can be driven in both rotating directions. The servicing device 60 also contains a gripper, particularly a suction gripper 64, by means of which the double yarn 63 is taken up and inserted into the splicing device 65. This double yarn 63 is subsequently connected in the connecting device 65 with a newly spun double yarn 8.

In order to resume the spinning operation, the drafting units 3, 4 are first closed again, for which the weighting arm 19' is transferred into its operative position 19. This operation is controlled in a manner which is not shown in detail, by the servicing device 60 which emits a corresponding signal to the pneumatic press 23. The yarns 1, 2 delivered by the drafting units 3, 4 are first sucked off into the suction nozzles 56', 57'. The servicing device 60 is equipped with a suction gripper 69, which can be moved out in the direction of 25 the arrow (D) and can be applied to the nozzles 25', 29' with suction openings 70, 71, the suction gripper 69 also being equipped with a thrust piece 72, which places itself against the nozzle plate 34' and moves this nozzle plate 34' back into the operative position. Thus the suction nozzles 56', 57' move away from the outlet of the drafting units 3, 4, while the air nozzles 24., 28' resume their operative position and take in yarns 1, 2.

The suction gripper 69 takes up the two yarns 1, 2, which then, preferably by means of the suction gripper 69, are also placed in the connecting device 65, in which case, they previously, in a manner described in the following, were combined to a double yarn 8. This double yarn 8 moves via a yarn storage device 67, which is connected to a suction device 68 and which is active while the yarn connection, particularly a spliced connection, is produced and takes in the yarn quantity which is continuously supplied during this connecting operation. After the yarn connection is established, the double yarn 8 is wound onto the partially wound package 47' via the auxiliary wind-up roller 61. After the yarn quantity produced during the piecing is wound onto the cross-wound package 47', it is returned to the winding roller 48, in which case, the double yarn 8 is transferred into the withdrawal device 7 of the respective spinning unit.

As shown in FIG. 5, the actual suction gripper 69 has a U-shape, which ends in the two suction openings 70, 71 and which is guided together to form a common suction line 73. The suction gripper 69 is arranged on an angular arm 74, which is equipped with driving elements, which are not shown and by means of which the suction gripper 69 can carry out the movements which will be described in the following. After the suction gripper 69 has taken over the two newly produced yarns 1, 2, it deposits these yarns 1, 2 in a yarn guide 75 so that they are combined to a double yarn 78. The yarn guide 75, which is shown in FIG. 5*a* in plan view, has a laterally open guiding slot 77 and a narrowing threading opening 76 leading to this guiding slot 77. The suction gripper 69 is first moved into position 69*a*, which is shown by a dash-dotted line. It then moves toward the other side so that the two yarns 1, 2 are placed in the yarn guide 75. An additional yarn guide 79 is assigned to the suction gripper 69, which will then be in position 69*b*, shown by an interrupted line. This yarn guide 79 holds the two yarns 1*b*, 2*b* together in such a manner that a double yarn is maintained which as such can be placed in the yarn connecting device 65.

As a modification of the embodiment according to FIG. 5 and FIG. 5*a*, a twisting nozzle 80 which has a longitudinal slot is connected behind the yarn guide 75 according to FIG. 6. This twisting nozzle 80 is equipped with tangentially directed blow nozzles 81 and causes a protective twist. In addition, the blow nozzles 81 are arranged to be inclined in withdrawal direction, so that the air nozzle 80 exercises a conveying effect on the double yarn 78 and thus promotes the correct withdrawal from the air nozzles 25, 29.

Figure 7:
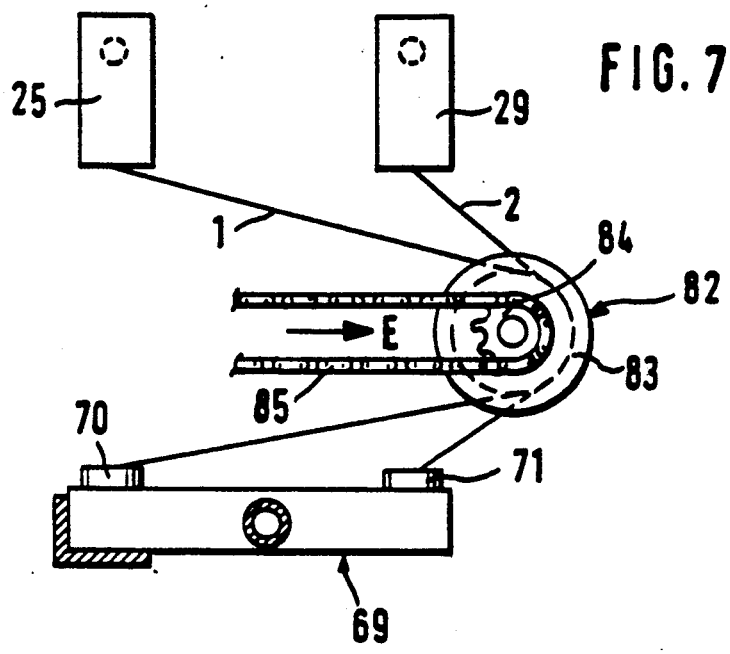
FIG. 7 is a schematic view showing details of a piecing arrangement having a grooved wheel for guiding the two single yarns together, constructed according to preferred embodiments of the invention.

In the embodiment according to FIG. 7, the guiding together of the yarns 1, 2 does not take place by the movement of the suction gripper 69, but by means of an additional element, specifically a grooved wheel 82, which is shifted in the plane of the two yarns 1, 2 transversely to the air nozzles 25, 29 and the suction gripPer 69 in the direction of the arrow (E). The two yarns 1, 2 are caught in the groove 83 of the grooved wheel 82. The grooved wheel 82 is equipped with a drive, such as a chain 85 moving via a chain wheel 84 and driving the grooved wheel 82 at an operational withdrawal speed. This ensures that the suction nozzle 69 does not determine the withdrawal speed at which the yarns 1, 2 are withdrawn from the air nozzles 25, 29, but rather the grooved wheel 82 determines this speed. As a result, a better control of the correct speed becomes possible.

Figure 8:
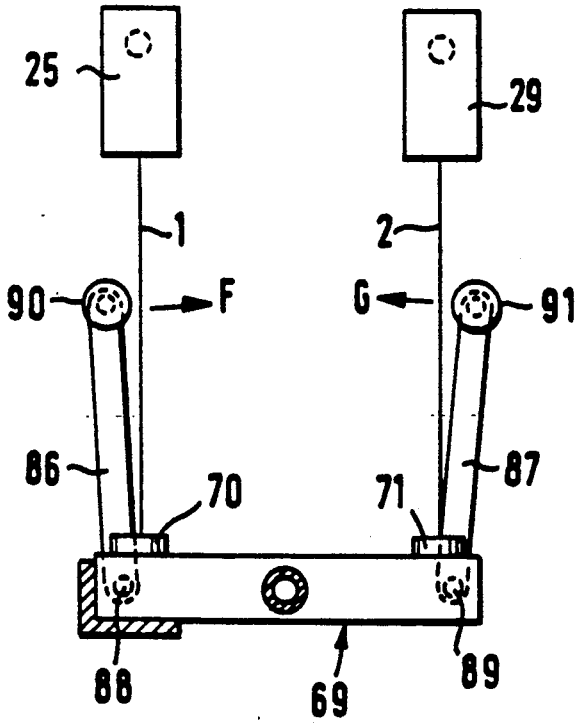
FIG. 8 schematically depicts another preferred embodiment of the invention with devices for guiding the yarns together, which are combined with the suction gripper.

In the embodiment according to FIG. 8, the guiding together of the two yarns 1, 2 takes place via devices which are connected with the suction gripper 69. In this embodiment, arms 86, 87 are mounted at the suction gripper 69, and can be swivelled around shafts 88, 89 and can be swivelled toward one another, in the direction of the arrows (F and G), can be swivelled toward one another such that two rollers 90, 91 disposed at their ends take up the yarns 1, 2 between one another. The two rollers 90, 91 may be provided with guiding grooves. In a modification, it is provided that the two rollers 90, 91 act as a pair of withdrawal rollers; i.e., take up the yarns 1, 2 between one another while exercising a clamping force, in which case the rollers 90, 91 are then driven correspondingly.

Figure 9:
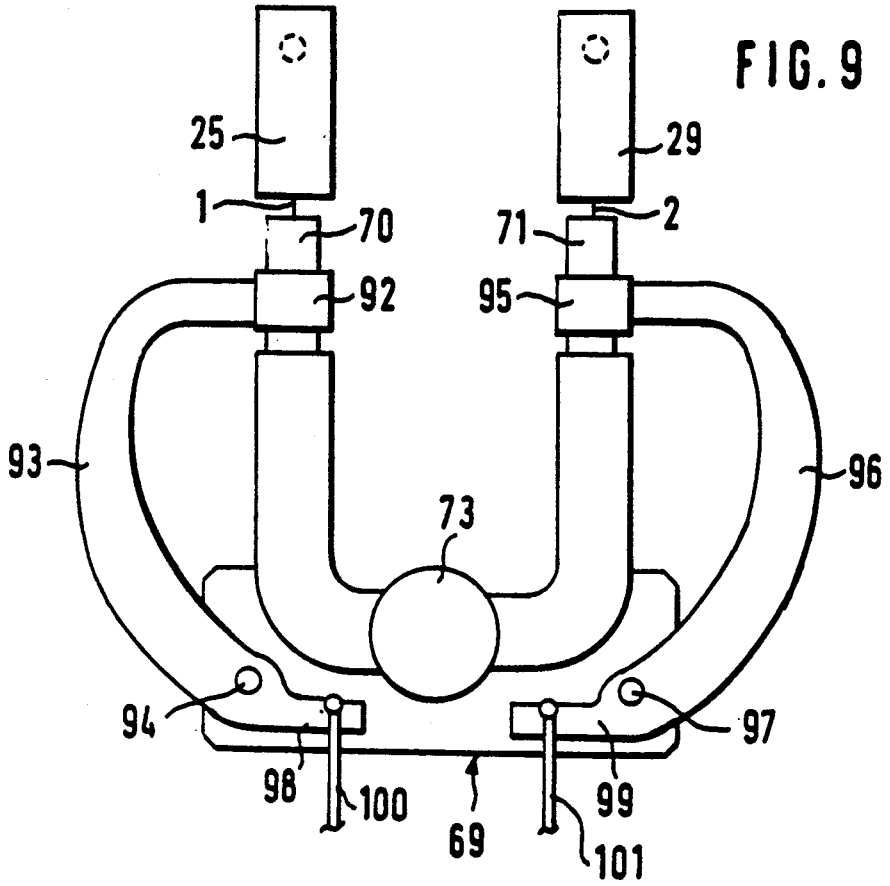
FIG. 9 schematically depicts another preferred embodiment of the invention with devices for guiding the yarns together, which are combined with the suction gripper.

In the embodiment according to FIG. 9, it is provided that the suction gripper 69 is constructed such that the two suction openings 70, 71 can be moved toward one another such that the two yarns 1, 2 are combined to a double yarn by the suction gripper 69 itself. The suction openings 70, 71 are part of connection pieces which are connected via flexible lines with the central suction line 73. The connection pieces, which form the suction openings 70, 71, are held in straps 92, 95, which are mounted at arms 93, 96, which are fastened at the suction gripper 69 so that they can be swivelled around shafts 94, 97. Tension elements 100, 101, by the operation of which the suction openings 70, 71 can be moved toward one another and away from one another, are applied to projections 98, 99 of the arms 93, 96, which are directed toward one another.

Figure 10:
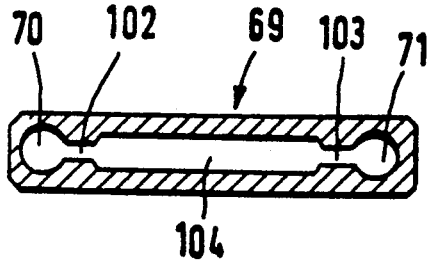
FIG. 10 is a sectional view of the mouth area of a suction gripper constructed according to preferred embodiments of the invention, in which two suction openings which are connected with one another are present.

FIG. 10 is a sectional view of an area of a mouth of a suction gripper 69 which, in addition to the two suction openings 70, 71, which can be applied to the air nozzles 25, 29, has a suction opening 104, which is arranged between these suction openings 70, 71 and, via the slots 102, 103, is connected with these two suction openings 70, 71. When this suction gripper 69 moves away from the air nozzles 25, 29, the yarns 1, 2 are first located in the suction openings 70, 71. Since they are, however, continuously sucked off by the central suction line 73, they receive a force component which moves them toward one another, in which case, they reach the central suction opening 104 via the slots 102, 103.

In a modified application of the embodiment according to FIG. 10, it is provided that a yarn guiding element is assigned to this suction gripper 69, this yarn guiding element deflecting one of the two yarns 1 or 2, after the suction gripper 69 has moved away from the air nozzles 25, 29, and guiding it to the suction opening 70 or 71 of the respective other yarn, so that here also a combining to a double yarn is obtained.

Figure 11:
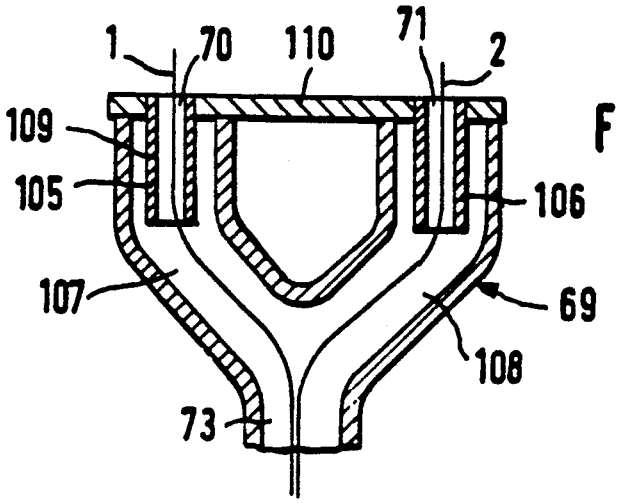
FIG. 11 is a sectional view of a suction gripper constructed according to another preferred embodiment, which, in addition, contains false twisting elements.

In the embodiment according to FIG. 11, the suction gripper 69 is equipped with inserts 105, 106, which form the suction openings 70, 71 for the yarns 1, 2. The inserts 105, 106 are provided with bores 109, which extend diagonally in conveying direction and are also directed tangentially and by means of which an air twist is generated so that it is possible to generate a false twist in the yarns 1, 2. The inserts 105, 106 are located in two duct segments 107, 108, which later combine to form a suction duct 73. As a modification of the shown embodiment, it is possible to increase the false twisting effect by the fact that, in the area of the bores 109, compressed air is blown into the inserts 105, 106, which will then act as injector suction nozzles.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Spinning machine apparatus comprising yarn component transfer means for transferring a pair of yarn components supplied by a pair of substantially spaced apart false twisting means to yarn connecting means for connecting the yarn components with a pair of previously formed closed adjacent yarn components, wherein said yarn component transfer means includes suction gripper means for simultaneously gripping the yarn components at the spaced apart false twisting means, gripper moving means for moving the gripper means and gripped yarn components from the false twisting means to a yarn connecting means and yarn component guide means for guidably moving the yarn components substantially closer together to form a double yarn during movement of the gripper means from the false twisting means to the yarn connecting means, wherein the suction gripper means has two distinct suction openings connected to a common suction pipe, said suction openings being spaced from one another by a distance corresponding to the distance between the yarn component outlets of the spaced apart false twisting means.

2. Apparatus according to claim 1 comprising a plurality of spinning units which each include:

a pair of adjacent drafting units for drafting the two yarn components, a pair of adjacent false twisting means arranged downstream of the drafting units and including means for applying a false twist to the two yarn components;

yarn winding means for winding up the double yarn on a feeding package to be used for subsequent twisting operations, and yarn connecting means for connecting yarn components withdrawn from the feeding package with yarn components emerging from the false twisting means, said suction gripper means forming part of the yarn correcting mean;

wherein said suction gripper means includes means for sucking in the yarn components emerging from the false twisting means at a position upstream of the yarn withdrawal means adjacent respective outlet ends of the false twisting means.

3. Apparatus according to claim 2, wherein the false twisting means includes pneumatic false twisting nozzles extending parallel to and spaced from one another.

4. Apparatus according to claim 2, wherein the suction gripper means is combined with devices for starting the operation of the false twisting means.

5. Apparatus according to claim 2, wherein the suction gripper means is equipped with devices for transferring the false twisting means from an inoperative position to an operative position.

6. Apparatus according to claim 2, wherein the yarn connecting means contain a delivery device, which can be arranged in the path of the yarn components between the suction gripper means and the false twisting means.

7. Apparatus according to claim 2, wherein the two suction openings are movably mounted relative to one another on a common holding element.

8. Apparatus according to claim 2, wherein the suction gripper means can be moved relative to a yarn guide guiding together the two yarn components and forming the component yarn guide means.

9. Apparatus according to claim 2, wherein the suction gripper is equipped with false twisting elements for the yarn components.

10. Apparatus according to claim 1 wherein the yarn connecting means contain a delivery device arranged in the path of the yarn components between the suction gripper means and the false twisting means.

11. Apparatus according to claim 10, wherein the yarn component guide means are combined with a false twisting element.

12. Apparatus according to claim 1, wherein the yarn component guide means form a constructional unit with the suction gripper means.

13. Apparatus according to claim 1, wherein the two suction openings of the suction gripper means are movably mounted relative to one another on a common holding element.

14. Apparatus according to claim 1, wherein the yarn component guide means can be applied from the direction of the side in the opposite direction of the two yarn components.

15. Apparatus according to claim 1, wherein the yarn component guide means are constructed as devices for conveying the double yarn.

16. Apparatus according to claim 15, wherein a grooved roller is used as the device for guiding together and conveying the two yarn components.

17. Apparatus according to claim 1, wherein an injector nozzle is used as the device for guiding together and conveying the two yarn components.

18. Apparatus according to claim 17, wherein the injector nozzle is constructed as a false twisting nozzle.

19. Apparatus according to claim 1, wherein two rollers, which can be moved toward one another and take the yarn components between one another, are provided as the device for guiding together and conveying the two yarn components.

20. Apparatus according to claim 1, wherein the suction gripper is equipped with false twisting elements for the yarn components.

21. Spinning machine apparatus according to claim 1, wherein said gripper means includes a unitary suction gripper with the two spaced apart suction openings for accepting the yarn components at the respective false twisting means, and wherein said yarn component guide means includes guide protrusions in the suction gripper means for permitting guiding of the two yarn components together within the suction means.

22. A spinning machine apparatus according to claim 21, wherein said suction gripper nozzles is a unitary nozzle with a center open space which is connected by laterally extending slots to cylindrical openings for the yarn components, whereby the yarn components can be guided together into the central space as they are being sucked into the gripper means from the outlets of the false twisting means.

* * * * *